US008382012B2

(12) United States Patent
Park et al.

(10) Patent No.: US 8,382,012 B2
(45) Date of Patent: Feb. 26, 2013

(54) DEVICE FOR REMOVABLY COUPLING DISPOSABLE NOZZLE TIP FOR BIDET

(75) Inventors: Jong Chul Park, Incheon (KR); Nam Choul Baek, Daejeon (KR); Woun Sik Oh, Hwaseong-si (KR)

(73) Assignee: SAMHONG TECH Co., Ltd., Anyang-Si, Gyeonggi-Do (KR)

( * ) Notice: Subject to any disclaimer, the term of this patent is extended or adjusted under 35 U.S.C. 154(b) by 247 days.

(21) Appl. No.: 12/887,490

(22) Filed: Sep. 21, 2010

(65) Prior Publication Data

US 2011/0010834 A1 Jan. 20, 2011

Related U.S. Application Data

(63) Continuation of application No. 12/144,873, filed on Jun. 24, 2008, now abandoned.

(30) Foreign Application Priority Data

Dec. 3, 2007 (KR) ..... 20-2007-0019362
Apr. 30, 2008 (KR) ..... 10-2008-0040605

(51) Int. Cl.
*B05B 1/14* (2006.01)

(52) U.S. Cl. ..... 239/590; 239/73; 239/280; 239/394; 239/505; 239/600

(58) Field of Classification Search ..... 239/73, 239/273, 275, 279, 280, 502, 504, 506, 518, 239/521, 523, 524, 530, 532, 600, DIG. 4, 239/390–397, 590–591, 505
See application file for complete search history.

(56) References Cited

U.S. PATENT DOCUMENTS

| | | | | |
|---|---|---|---|---|
| 2,999,648 | A * | 9/1961 | Wahlin et al. | 239/487 |
| 4,011,017 | A | 3/1977 | Feuerstein et al. | |
| 4,168,033 | A * | 9/1979 | von Bernuth et al. | 239/523 |
| 4,353,508 | A * | 10/1982 | Butterfield et al. | 239/590.3 |
| 5,613,316 | A | 3/1997 | Hightower | |
| 5,921,468 | A | 7/1999 | Palestrant | |
| 7,051,959 | B2 * | 5/2006 | Lim | 239/548 |

* cited by examiner

*Primary Examiner* — Christopher Kim
(74) *Attorney, Agent, or Firm* — Lowe Hauptman Ham & Berner, LLP

(57) ABSTRACT

Disclosed herein is a device for removably coupling a disposable nozzle tip for a bidet. The device includes a nozzle, a nozzle tip, a guide cover, and a removable coupling unit. The nozzle has a nozzle body through which a washing-water guide hole passes, and a coupling hole. The nozzle tip has a coupling protrusion removably inserted into the coupling hole, and a jet hole to spray washing water. The guide cover is secured to a bottom of the nozzle tip in such a way as to be positioned under the jet hole, and guides the washing water to the jet hole. The removable coupling unit includes external threads formed in an outer circumference of the coupling protrusion, and internal threads formed in an inner circumference of the coupling hole. Further, the device includes stoppers comprising a pair of a protrusion and a hole, or a pair of protrusions, provided on the nozzle and the nozzle tip in such a way as to be symmetric with respect to each other, and preventing the nozzle tip from excessively rotating relative to the nozzle. The device provides a clean nozzle tip, thus allowing the genital and anal areas to be hygienically washed using washing water, and simplifies the structure of the nozzle tip, thus facilitating a mounting and detaching operation, and includes stoppers, thus preventing the nozzle and the nozzle tip from being damaged.

11 Claims, 12 Drawing Sheets

DEVICE FOR REMOVABLY COUPLING DISPOSABLE NOZZLE TIP FOR BIDET

CROSS-REFERENCE TO RELATED APPLICATION

The present Continuation application is based on, and claims priority from, U.S. application ser. No. 12/144,873, filed Jun. 24, 2008, the disclosure of which is hereby incorporated by reference herein in its entirety. This Continuation application also claims priority to and the benefits of Korean Patent Application Nos. 20-2007-0019362 and 10-2008-0040605 respectively filed in the Korean Intellectual Property Office on Dec. 3, 2007 and Apr. 30, 2008, the entire contents of which are incorporated herein by reference.

BACKGROUND OF THE INVENTION

1. Field of the Invention

The present invention relates generally to a device for removably coupling a disposable nozzle tip for a bidet and, more particularly, to a device for removably coupling a disposable nozzle tip for a bidet, which is capable of removably coupling the nozzle tip to a nozzle of the bidet so that the nozzle tip can be disposed of after use, thus being hygienic to use.

2. Description of the Related Art

Generally, a bidet is a fixture that washes a user's genital and anal areas using washing water sprayed through a nozzle tip, which is fused to a nozzle and is moved into and out of a bidet body, thus obviating the need to use toilet paper after defecating, and subsequently, removes water remaining on the genital and anal areas using warm air supplied by a drier. The bidet has been widely installed and used in bathrooms of homes and in restrooms of large buildings or in places frequented by many people.

As such, when the bidet, installed in the bathroom of the home or in the restroom of the large building or the place frequented by many people, is used, a user's genital and anal areas are washed using washing water sprayed from the nozzle tip of the nozzle, which protrudes outwards from the bidet body. At this time, because the nozzle tip is located under the user's buttocks, the nozzle and the nozzle tip may be stained with waste matter from the genital and anal areas.

In order to wash the nozzle or the nozzle tip stained with the waste matter, the nozzle equipped with the nozzle tip is ejected out from the bidet body under the control of a control unit. Thereafter, the nozzle and the nozzle tip are washed using a soft sponge, brush, or cloth covered with a detergent, and are rinsed using water. Afterwards, the nozzle and the nozzle tip are retracted into the bidet body under the control of the control unit.

However, the conventional nozzle tip is problematic in that, unless the nozzle tip fused to the nozzle is washed manually by a user, the bidet, used for keeping the user's genital and anal areas clean, may be poorly managed and thus unsanitary.

Recently, a bidet having an automatic nozzle washing function has been developed. When the bidet is operated, the nozzle is ejected to perform a washing function. When the washing operation has been completed, the nozzle returns to its original position. At this time, washing water is drained through the nozzle tip for a predetermined period of time so that the nozzle tip is cleaned.

However, the bidet is problematic in that waste matter is not completely removed from the nozzle equipped with the nozzle tip by the washing water drained through the nozzle tip, and thus waste matter may stick to the nozzle or the nozzle tip when the bidet has been used for a lengthy period of time. Thereby, the waste matter is not easily removed by the automatic nozzle washing function, thus giving an unpleasant feeling to a subsequent user.

Further, when a person who suffers from an anal disease or is infected with a virus uses the bidet installed in a restroom in a large building or a place frequented by many people, disease-causing germs may be transferred to the nozzle and the nozzle tip, so that subsequent users may catch the disease.

SUMMARY OF THE INVENTION

Accordingly, the present invention has been made keeping in mind the above problems occurring in the prior art, and an object of the present invention is to provide a device for removably coupling a disposable nozzle tip for a bidet, which allows the nozzle tip to be disposed of after use, thus preventing the nozzle tip from being contaminated by waste matter or disease-causing germs. Another object of the present invention is to provide a device for removably coupling a disposable nozzle tip for a bidet, which simplifies the structure of the disposable nozzle tip, mounted to a nozzle, and is provided with stoppers, thus facilitating mounting and detaching operations, and which does not require large force during the mounting and detaching operations, thus preventing the nozzle and the nozzle tip from being broken or damaged.

In order to accomplish the above objects, the present invention provides a device for removably coupling a disposable nozzle tip for a bidet, including a nozzle, a nozzle tip, a guide cover, and a removable coupling unit. The nozzle has a nozzle body through which a washing-water guide hole passes, with a coupling hole formed in an end of the nozzle body. The nozzle tip has a coupling protrusion removably inserted into the coupling hole in the nozzle, and has a jet hole to spray washing water. The guide cover is secured to a bottom of a front end of the nozzle tip in such a way as to be positioned under the jet hole, and guides the washing water to the jet hole. The removable coupling unit includes external threads formed in an outer circumference of the coupling protrusion of the nozzle tip, and internal threads formed in an inner circumference of the coupling hole of the nozzle.

Further, the device includes stoppers which comprises a pair of a protrusion and a hole, or a pair of protrusions which are provided on the nozzle and the nozzle tip in such a way as to be symmetric with respect to each other, and prevents the nozzle tip from excessively rotating relative to the nozzle when the nozzle tip is coupled to the nozzle.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
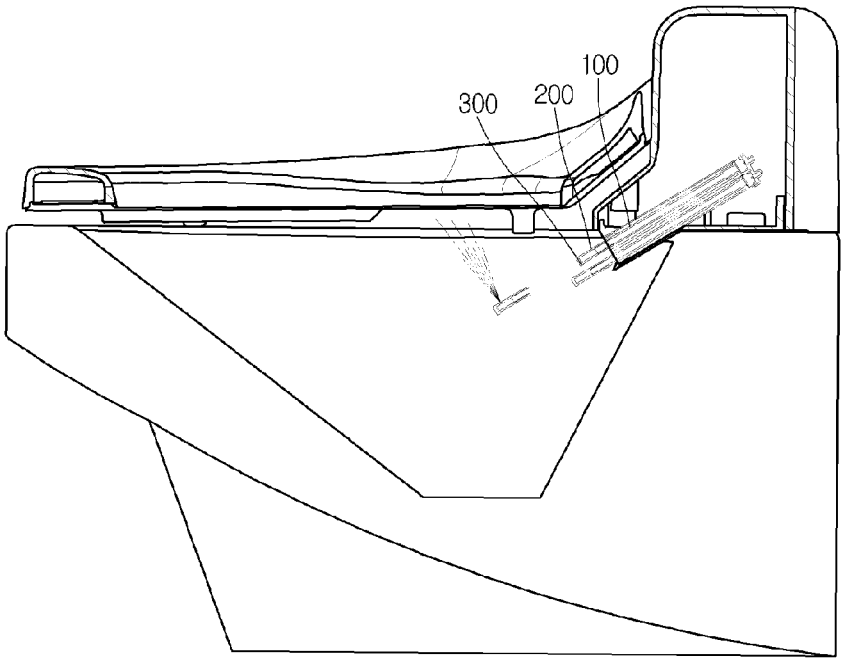
FIG. 1 is a view illustrating the installed state of a general nozzle.

Reference now should be made to the drawings, in which the same reference numerals are used throughout the different drawings to designate the same or similar components.

According to the present invention, a disposable nozzle tip coupling device includes a nozzle 100, a nozzle tip 200, a guide cover 300, and a removable coupling unit 400. The nozzle has a nozzle body 110 through which a washing-water guide hole 120 passes. A coupling hole 130 is formed in one end of the nozzle body 110. The nozzle tip 200 includes a coupling protrusion 240, which is removably coupled inserted into the coupling hole 130 in the nozzle 100, and includes a jet hole 230 to spray washing water. The guide cover 300 is secured to the bottom of the front end of the nozzle tip 200 in such a way as to be located under the jet hole 230, and functions to guide washing water to the jet hole 230. The removable coupling unit 400 includes external threads 420 which are formed in the outer circumference of the coupling protrusion 240 of the nozzle tip 200, and internal threads 410 which are formed in the inner circumference of the coupling hole 130 of the nozzle 100.

The tip coupling device may further include stoppers 500 and 510, which are provided on the nozzle 100 and the nozzle tip 200, and comprise a protrusion and a hole, or a pair of protrusions that are symmetric with respect to each other. When the nozzle tip 200 is fastened to the nozzle 100, the stoppers 500 and 510 prevent the nozzle tip 200 from excessively rotating relative to the nozzle 100.

According to another embodiment of the present invention, the nozzle tip 200 includes a nozzle-tip body 210, through which a washing-water guide hole 220 passes in such a way as to be arranged along the same line as the washing-water guide hole 120 in the nozzle 100. The jet hole 230 is formed in the nozzle-tip body 210 to communicate with the washing-water guide hole 220, and is located at a position around the genital and anal areas. The coupling protrusion 240 protrudes from one end of the nozzle-tip body 210 in such a way as to be opposite the jet hole 230, and is inserted into the coupling hole 130 in the nozzle 100. A sealing member 250 may be mounted to the outer circumference of the coupling protrusion 240.

According to a further embodiment of the present invention, the guide cover 300 is provided with a cover body 310 which is provided on the bottom of the body 210 of the nozzle tip 200 to close the lower end of the jet hole 230. A guide projection 320 is bent upwards from the cover body 310, and guides washing water from the washing-water guide hole 220 to the jet hole 230.

According to another embodiment of the present invention, the cross-section of each of the nozzle 100 and the nozzle tip 200 may have various shapes, including a circular shape, an elliptical shape, and a polygonal shape, without being limited to any specific shape.

According to another embodiment of the present invention, the stoppers 500 and 510, which are provided on the nozzle 100 and the nozzle tip 200 to be symmetric with respect to each other, may be provided on any outer surfaces of the nozzle 100 and the nozzle tip 200, or may be provided at any portions in the removable coupling unit 400. According to the present invention, the stopper 500 provided at the nozzle 100 and the stopper 510 provided at the nozzle tip 200 have corresponding shapes such that the stoppers 500 and 510 contact each other. Unlike the stoppers 500 and 510 shown in the drawing, the stopper 510 may be provided at the nozzle 100, while the stopper 500 may be provided at the nozzle tip 200.

Hereinafter, the preferred embodiment of the present invention will be described in detail with reference to the accompanying drawings.

Figure 2:
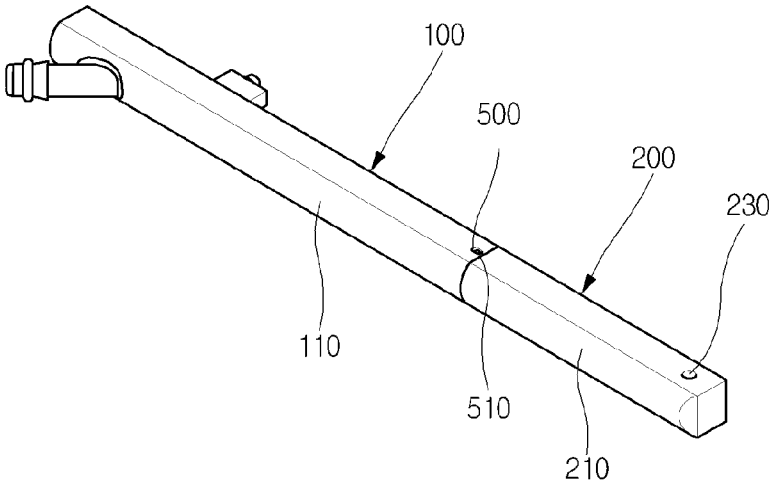
FIG. 2 is a perspective view illustrating a device for removably coupling a disposable nozzle tip for a bidet, according to the present invention.
Figure 3:
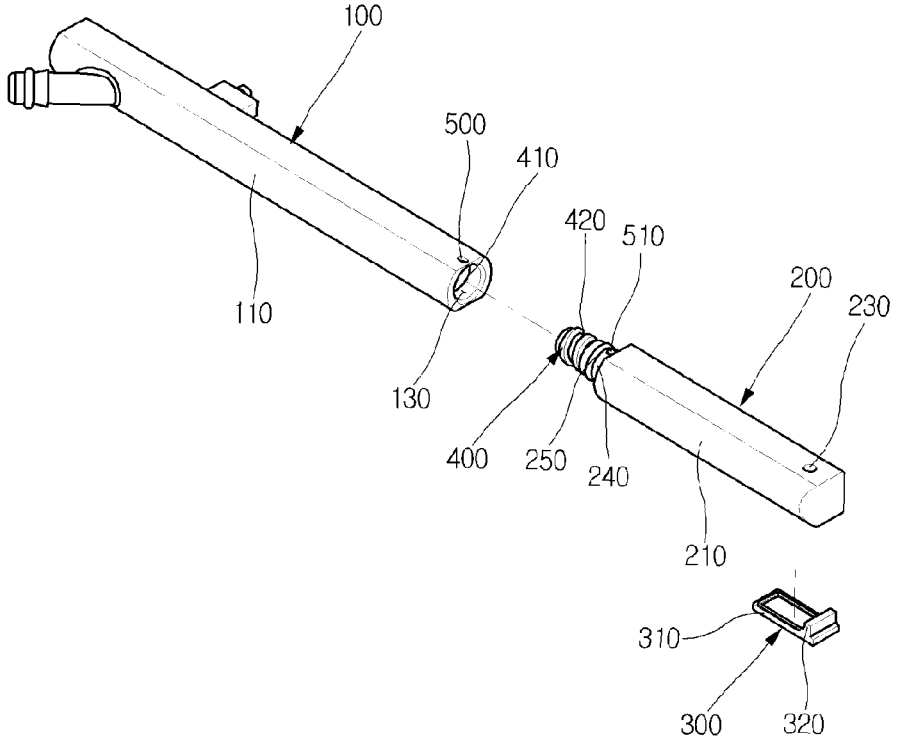
FIG. 3 is an exploded perspective view illustrating the tip coupling device according to the present invention.
Figure 4:
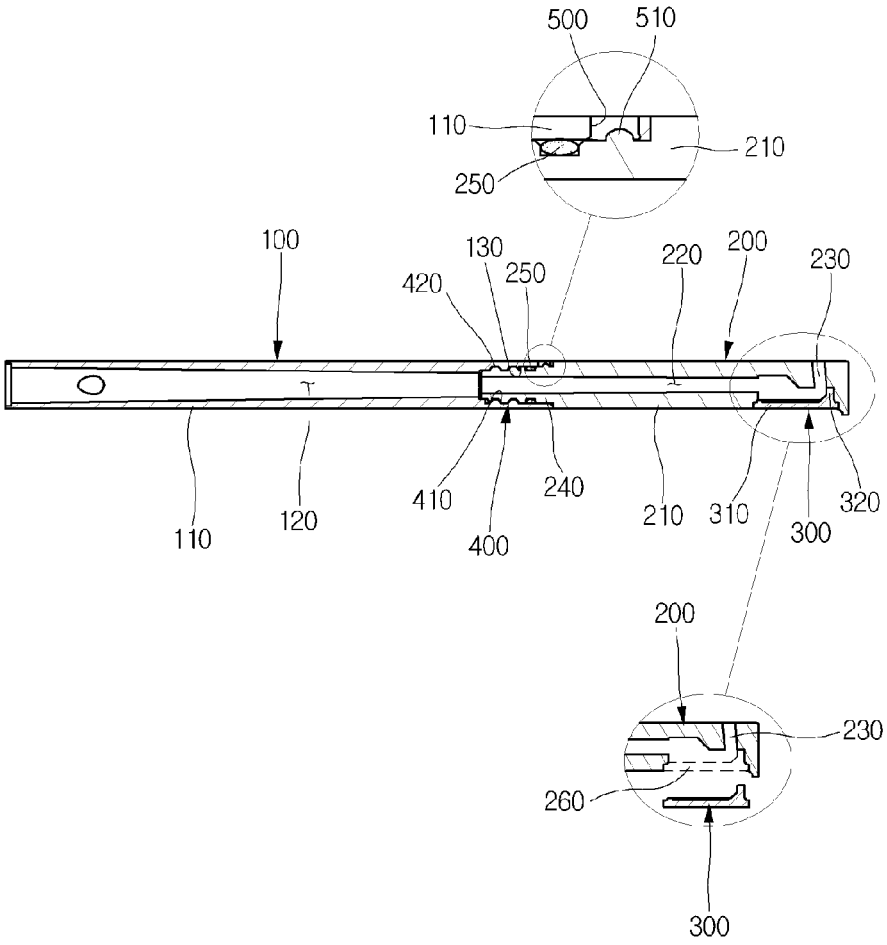
FIG. 4 is a side sectional view illustrating the tip coupling device according to the present invention.

FIG. 1 is a view illustrating the installed state of a general nozzle, FIG. 2 is a perspective view illustrating a device for removably coupling a disposable nozzle tip for a bidet, according to the present invention, FIG. 3 is an exploded perspective view illustrating the tip coupling device according to the present invention, and FIG. 4 is a side sectional view illustrating the tip coupling device according to the present invention.

Figure 5:
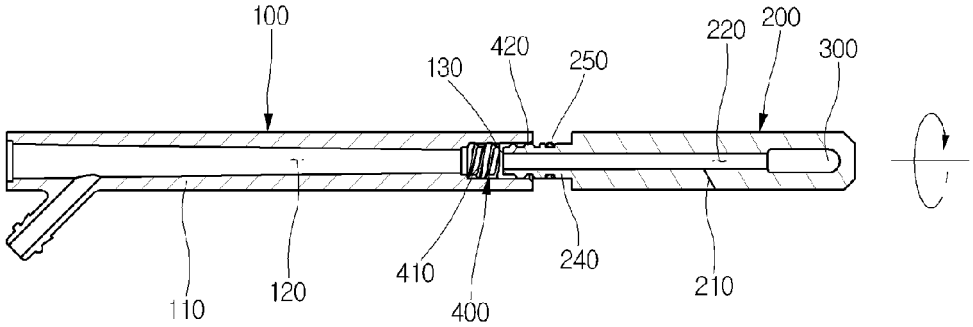
FIGS. 5 and 6 are plan sectional views illustrating the state in which the nozzle tip is coupled to a nozzle, according to the present invention.
Figure 6:
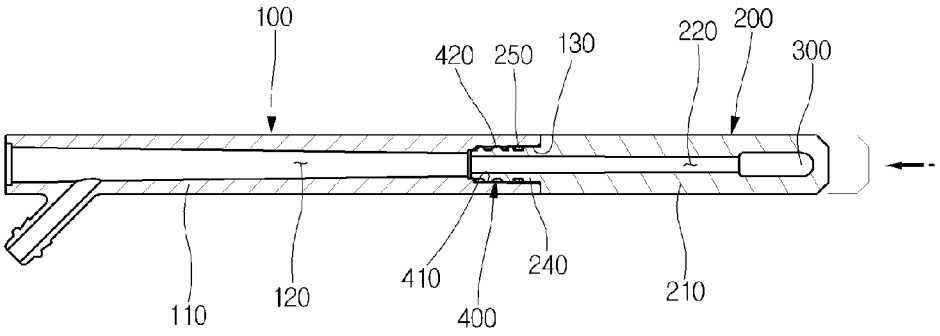

First, in order to close the lower end of the jet hole 230 of the nozzle tip 200, the cover body 310 of the guide cover 300 is mounted to the nozzle tip 200, and thereafter, the nozzle tip 200 is coupled to the nozzle 100. Specifically, the nozzle tip 200 has an open portion 260 opposing the jet hole 230, and the guide cover 300 is removably attached to the open portion 260. Referring to FIG. 4, a thickness of the cover body 310 is smaller than a thickness of a bottom sidewall neighboring the open portion 260. As shown in FIGS. 5 and 6, while the external threads 420 of the removable coupling unit 400, which are provided in the outer circumference of the coupling protrusion 240 of the nozzle tip 200, are moved into the coupling hole 130 in the nozzle 100, the external threads 420 are in close contact with the internal threads 410, which are formed in the inner circumference of the coupling hole 130.

In this case, when the nozzle tip 200 is rotated forwards, the external threads 420 provided in the outer circumference of the coupling protrusion 240 of the nozzle tip 200 engage with the internal threads 410 provided in the inner circumference of the coupling hole 130 of the nozzle 100. Simultaneously, the coupling protrusion 240 of the nozzle tip 200 is moved into the coupling hole 130 in the nozzle 100.

While the coupling protrusion 240 of the nozzle tip 200 is moved into the coupling hole 130 in the nozzle 100, the sealing member 250, mounted to the outer circumference of the coupling protrusion 240, tightly closes the coupling hole 130, thus preventing the leakage of washing water supplied to the washing-water guide hole 120.

Here, the nozzle tip 200 having the external threads 420 and the nozzle 100 having the internal threads 410 are arranged such that the upper surfaces of the nozzle tip 200 and the nozzle 100 are aligned with each other, and the jet hole 230 of the nozzle tip 200 faces upwards, by adjusting the internal threads 410 engaging with the external threads 420 of the removable coupling unit 400.

Meanwhile, a pair of stoppers 500 and 510, which are provided on the outer portions of the nozzle 100 and the nozzle tip 200 or the inner portion of the removable coupling unit 400, comprises a protrusion and a hole, or comprises protrusions. When a user desires to couple the nozzle 100 and the nozzle tip 200 to each other, the nozzle tip 200 is rotated such that the coupling protrusion 240 of the nozzle tip 200 is inserted into the coupling hole 130 in the nozzle 100. When the coupling of the nozzle tip 200 with the nozzle 100 has been completed, the stoppers 500 and 510, which are provided, respectively, on the nozzle 100 and the nozzle tip 200, come into close contact with each other or are coupled to each other through fitting so as to prevent the nozzle tip 200 from rotating any further. As shown in FIGS. 9 to 12, when the stoppers 500 and 510 comprise a protrusion and a hole, the protrusion is fitted into the corresponding hole. Meanwhile, when the stoppers 500 and 510 comprise protrusions, the protrusions come into contact with each other, thus preventing the rotation of the nozzle tip 200. In this way, excessive rotation of the nozzle tip 200 is prevented. Further, even if the stoppers 500 and 510 comprise protrusions, according to the shape of respective protrusions, the protrusions slide along inclined surface thereof to contact each other, and thereafter may be coupled to each other through fitting.

According to the present invention, assembled through the above-mentioned process, after a user sits on a seat of a bidet and defecates, the nozzle 100 is controlled by a control unit to move out of a bidet body by the power of a motor. Thereby, the nozzle tip 200, coupled to the nozzle 100, is located under his or her buttocks. Simultaneously, washing water is supplied from a water tank of the bidet, and passes through the washing-water guide holes 120 and 220 in the nozzle 100 and the nozzle tip 200. The washing water passing through the washing-water guide hole 220 is guided along the bent guide projection 320 of the guide cover 300 to the jet hole 230. The washing water guided to the jet hole 230 is sprayed out from the jet hole 230, thus washing the user's genital and anal areas.

Here, since the nozzle tip 200 coupled to the nozzle 100 is located under a user's buttocks, his or her waste matter may splash about because of the washing water sprayed through the jet hole 230 of the nozzle tip 200, so that the body 210 of the nozzle tip 200 may become stained with the waste matter, and the nozzle tip 200 may be contaminated. After the user's genital and anal areas are washed, water remaining around the genital and anal areas is removed using warm air supplied by a drier. Afterwards, feces are discharged from a toilet.

Figure 7:
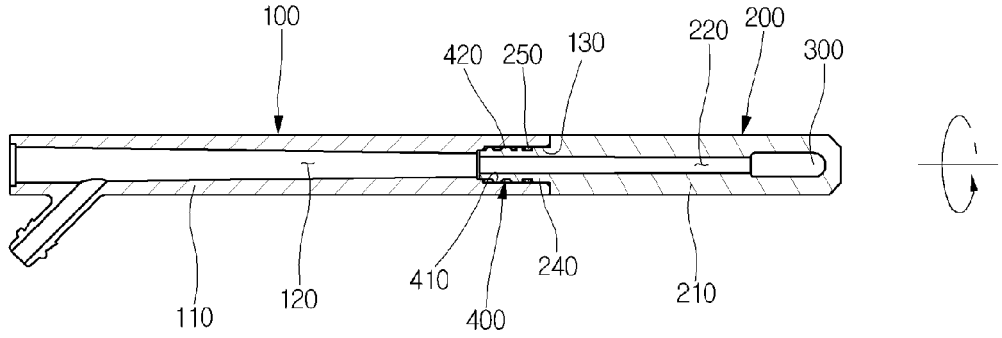
FIGS. 7 and 8 are plan sectional views illustrating the state in which the nozzle tip is removed from the nozzle, according to the present invention.
Figure 8:
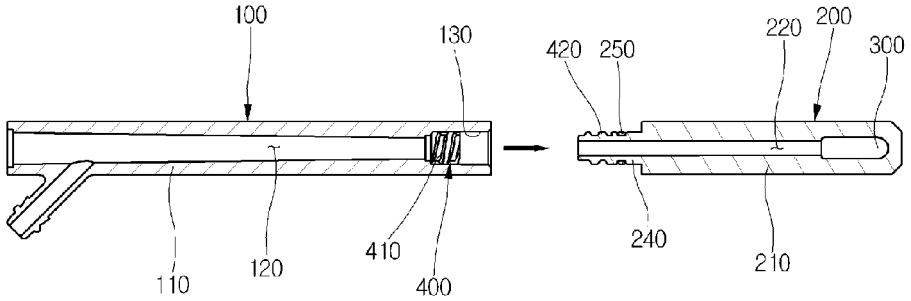
Figure 9:
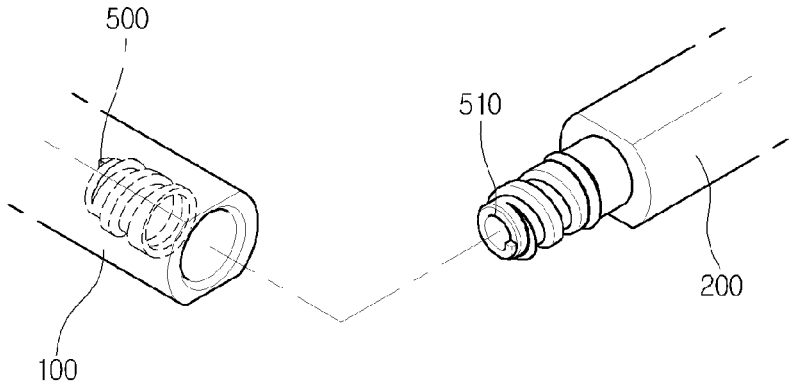
FIGS. 9 to 12 are exploded perspective views illustrating stoppers according to several embodiments of the present invention.
Figure 10:
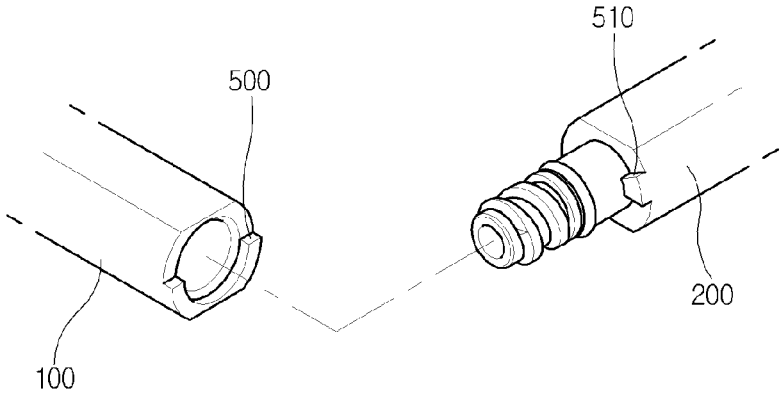
Figure 11:
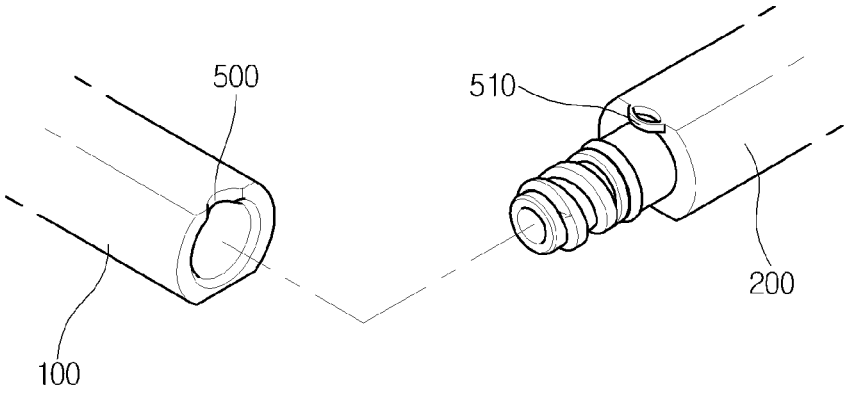
Figure 12:
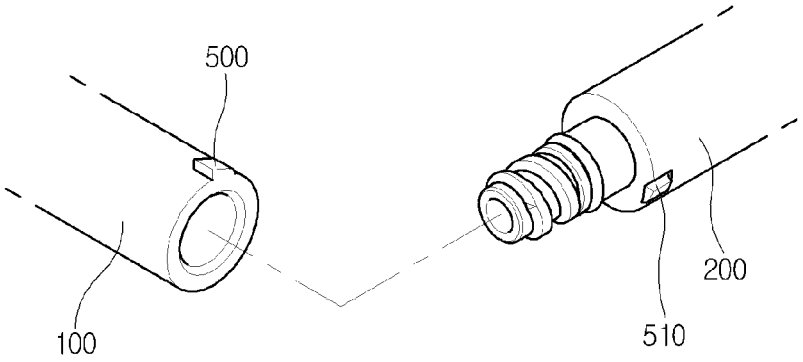

Meanwhile, when a user desires to remove the nozzle tip 200 from the nozzle 100 or to replace the nozzle tip 200 with a new one for a subsequent user, after feces are washed away, as shown in FIGS. 7 and 8, the nozzle tip 200, coupled to the nozzle 100, is rotated backwards. In this case, the external threads 420, provided in the outer circumference of the coupling protrusion 240 of the nozzle tip 200, move along the internal threads 410, provided in the inner circumference of the coupling hole 130 in the nozzle 100, so that the coupling protrusion 240 of the nozzle tip 200 is moved out of the coupling hole 130 of the nozzle 100.

While the coupling protrusion 240 of the nozzle tip 200 is moved out of the coupling hole 130 of the nozzle 100, the sealing member 250, mounted to the outer circumference of the coupling protrusion 240, is moved out of the coupling hole 130. When the rotating force of the nozzle tip 200 is larger than the frictional force of the sealing member 250, which brings the inner circumference of the coupling hole 130 into close contact with the outer circumference of the coupling protrusion 240, and the stoppers 500 and 510, the nozzle tip 200 can be rotated and thus removed from the nozzle 100.

After the nozzle tip 200 is removed from the nozzle 100 through the above-mentioned process, another nozzle tip is mounted to the nozzle 100 through the above-mentioned process, thus washing a user's genital and anal areas, or being ready to wash a user's genital and anal areas.

As described above, the present invention provides a device for removably coupling a disposable nozzle tip for a bidet, which provides a clean nozzle tip which is not contaminated by waste matter or disease-causing germs, thus allowing the genital and anal areas to be hygienically washed using washing water sprayed from the clean nozzle tip, and which simplifies the structure of the disposable nozzle tip mounted to the nozzle, thus facilitating a mounting and detaching operation, and which is provided with stoppers so as to prevent the nozzle tip from excessively rotating relative to the nozzle, thus preventing the nozzle and the nozzle tip from being broken or damaged.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A bidet device for providing water in a toilet, comprising:

a bidet nozzle having therein a first passage through which washing water flows;

a bidet nozzle tip configured to be removably coupled to the bidet nozzle and having an open portion, having:

a second passage therein through which the washing water from the first passage flows; and a jet hole for spraying the washing water from the second passage, the jet hole opposing the open portion ; and a guide cover configured to be removably attached to the open portion, having:

a cover body for closing the open portion and guiding the washing water; and a guide projection protruding from the cover body toward the jet hole for guiding the washing water from the second passage to the jet hole, wherein a thickness of the cover body is smaller than a thickness of a bottom sidewall neighboring the open portion, and an inner surface of the nozzle tip opposing the cover body is indented, such that a cross-sectional width of the second passage in a guide section surrounded by the cover body and the indented inner surface is larger than widths of the jet hole and other sections of the second passage that are not surrounded by the cover body and the indented inner surface.

2. The bidet device according to claim 1, further comprising stoppers formed on the bidet nozzle and the bidet nozzle tip for preventing the bidet nozzle tip from excessively rotating relative to the bidet nozzle, the stoppers including a pair of a protrusion and a hole, or a pair of protrusions.

3. The bidet device according to claim 2, wherein the stoppers include the protrusion formed on the bidet nozzle tip to be fitted into the hole formed on the bidet nozzle when the bidet nozzle tip is coupled to the bidet nozzle.

4. The bidet device according to claim 2, wherein the stoppers are formed to stop the bidet nozzle tip at a position where the jet hole is directed upwardly without being tilted around an axis of the bidet nozzle.

5. The bidet device according to claim 1, wherein the first passage is aligned with and fluidly connected with the second passage when the bidet nozzle tip is coupled to the bidet nozzle.

6. The bidet device according to claim 1, wherein the second passage is fluidly connected with the jet hole.

7. The bidet device according to claim 1, wherein a coupling protrusion is formed on a coupling end of the bidet nozzle tip to be opposite to the jet hole, and a coupling receptacle is formed on a coupling end of the bidet nozzle, such that the coupling protrusion is inserted into the coupling receptacle when the bidet nozzle tip is coupled to the bidet nozzle.

8. The bidet device according to claim 7, wherein external threads are formed in an outer circumference of the coupling protrusion of the bidet nozzle tip, and internal threads are formed in an inner circumference of the coupling receptacle of the bidet nozzle, such that the external threads are fitted into the internal threads by rotation.

9. The bidet device according to claim 8, wherein a sealing member is mounted to the outer circumference of the coupling protrusion.

10. The bidet device according to claim 1, wherein the guide projection is formed to have a curved surface to facilitate changing a direction of the washing water from the second passage to the jet hole.

11. The bidet device according to claim 1, wherein the cover body is attached from a bottom of the bidet nozzle tip to the open portion, and the guide projection is formed to protrude upwardly from the cover body, such that the washing water is guided upwardly from the second passage to the jet hole.

* * * * *